United States Patent [19]

Filko et al.

[11] 4,036,415

[45] July 19, 1977

[54] GLOVE TURNING AND BLOCKING PROCESS AND APPARATUS

[75] Inventors: Colin Filko; Richard Stanley Smith, both of Winnipeg; Lawrie Gandièr McIntosh, Etobicoke; Willem John Bouman, Toronto, all of Canada

[73] Assignee: Sterling Glove Machinery Ltd., Winnipeg, Canada

[21] Appl. No.: 747,670

[22] Filed: Dec. 6, 1976

Related U.S. Application Data

[63] Continuation-in-part of Ser. No. 636,590, Dec. 1, 1975.

[51] Int. Cl.[2] ..... A41H 43/00

[52] U.S. Cl. ..... 223/40; 223/78

[58] Field of Search ..... 223/39–43, 223/78, 79, 51, 52, 80, 57

[56] References Cited

U.S. PATENT DOCUMENTS

| | | | |
|---|---|---|---|
| 3,656,669 | 4/1972 | Conklin et al. | 223/40 |
| 3,738,547 | 6/1973 | Horton | 223/40 |

*Primary Examiner*—G. V. Larkin

*Attorney, Agent, or Firm*—Robert G. Hirons

[57] ABSTRACT

A process of simultaneously turning and blocking a leather glove is disclosed, in which the fingers of the glove are initially mounted upon elongated members of relatively small diameter, and are turned onto heated mandrels of relatively larger diameter. The stretching of the finger portions as they are turned in this manner, combined with the application of heat from the heated mandrels, causes simultaneous blocking of the glove fingers as they are turned. In an apparatus for carrying out this process, the finger receiving members of lesser diameter are rods, and the mandrels onto which the fingers are turned are tubular. A wrist clamp is provided, which grips the inside of the cuff portion of the glove, and draws the glove off the finger mounting members onto the heated mandrels by movement relative to the finger mounting members. The turning of the glove fingers is assisted by the provision of a muffling clamp which forms an air tight chamber with the glove on the wrist clamp, the chamber being pressured with a jet of heated air to separate the turning portion of the glove from the ends of the tubular mandrels so as to reduce friction on turning.

14 Claims, 12 Drawing Figures

GLOVE TURNING AND BLOCKING PROCESS AND APPARATUS

CROSS REFERENCE TO RELATED APPLICATION

This is a continuation-in-part application to our application Ser. No. 636,590 filed Dec. 15, 1975.

FIELD OF THE INVENTION

This invention relates to methods and apparatus for making gloves. More particularly, it relates to a method of and apparatus for turning stitched leather gloves from their inside out condition in which they are stiched, to their finished condition, and for flattening the stiched seams of the gloves which are consequently disposed inside the fingers of the finished glove.

BACKGROUND OF THE PRESENT INVENTION

Glove of leather and similar pre-formed materials are made by stiching together pre-cut pieces of the material. Since it is desirable that in the finished glove the stiched seams be out of the way and not visible, for functional and/or aesthetic reasons, a leather glove is stitched together inside out, with the seams projecting outwardly, and then reversed so that the seams will be disposed inside the finished glove. In order that the glove may be worn comfortably, the seams inside the fingers of the glove should not project inwardly to any great extent. It is therefore necessary to flatten the stitched seams. This is normally done after the glove is turned from its inside out condition, and is referred to in the art as blocking the glove.

Thus after a leather glove has been stitched together, there are the turning and blocking operations to be performed, before the glove is finished. Due to the relatively complex structure of a glove, with its finger, hand and cuff parts of different shapes, the turning and blocking operations do not readily lend themselves to performance by mechanical means in a simple, rapid and effective manner.

BRIEF DESCRIPTION OF THE PRIOR ART

It has previously been proposed to turn a stitched leather glove from inside out condition to right side out condition by mounting the inside out gloves on an apparatus comprising tubular finger members which extend inside the glove fingers. Then rods and plungers are pushed down that the fingers of the glove lie between the inside of the tubular finger members and the outside of the plungers, in their right side out condition. The cuff portion of the glove is gripped by hand or clamping means, and drawn upwardly over the tubular finger members so as to complete the turning of the glove. Examples of this type of glove turning apparatus are described in U.S. Pat. No. 3,738,547, Horton, U.S. Pat. No. 2,540,503 Becker, U.S. Pat. Nos. 2,286,058 and 2,286,058 Brownstein, U.S. Pat. No. 2,434,816 Suftko, U.S. Pat. No. 2,510,341 Keller and U.S. Pat. No. 978,434 Crosby.

In such glove turning processes and apparatus, however, considerable amounts of force have to be exerted to turn the fingers of the glove. This entails a substantial risk that the glove will be torn or otherwise damaged during the turning operation. Further, blocking of the glove is effected as a separate operation, either using separate apparatus, or using apparatus constituting a separate and distinct stage of a combined turning and blocking apparatus. Blocking of a leather glove is accomplished by applying heat to the seam in a forcibly stressed condition. Blocking is a time consuming process. In such prior art processes, the glove has to be held in the seam flattened condition at a temperature of about 300° F for a period of about 2 minutes, to accomplish the necessary blocking. This is a limitation in the production capacity of conventional leather glove making processes.

BRIEF SUMMARY OF THE INVENTION

An object of the present invention is to provide an improved process and apparatus for turning and blocking gloves of leather and the like materials.

A further object of the invention is to provide a glove finishing process in which turning and blocking of the glove is accomplished substantially simultaneously, as a single operation.

A further object of the invention is to provide a novel apparatus which will perform substantially simultaneous turning and blocking of leather and the like gloves.

Briefly stated, the objects of the present invention are accomplished by a process in which a stitched leather glove is initially mounted with at least one finger thereof, in an inside out condition, over a relatively small diameter finger mounting member, and then the glove finger is turned to right side out by rolling the glove finger onto the exterior surface of a relatively larger diameter finger receiving mandrel. Preferably there is substantially simultaneous application of heat to the glove finger, as it is turned. The turning is assisted by the provision of heated air to the inside of the glove as the finger portion is turned, to pressurize the finger and urge the leather thereof away from the mandrel onto which it is being turned. The turning of the glove by this process causes the necessary pressing under heat of the glove seams to effect blocking of the glove as it is turned, and lessens risk of tearing the glove leather during turning.

Apparatus for turning and blocking gloves comprises: at least one finger mounting member of relatively small diameter adapted to be received inside a finger of a stitched, inside out glove mounted thereon; at least one finger receiving mandrel of relatively larger diameter adapted to be arranged in substantial longitudinal alignment with said at least one finger mounting member; an expandable and retractable wrist clamp adapted to expand to grip the inside of the wrist portion of the glove mounted on said at least one finger mounting member, said wrist clamp being movable relative to said at least one finger mounting member in a direction longitudinally thereof towards and away from said at least one finger receiving mandrel, for transferring a glove finger mounted on said at least one finger mounting member onto said at least one finger receiving mandrel by rolling the finger onto the outer surface thereof; a sealing clamp surrounding said at least one finger receiving mandrel and adapted to engage with the edge of the wrist clamp to grip therebetween in substantially sealing manner an edge of a glove gripped by said wrist clamp, around the periphery of said edge; and means for supplying air pressure to the inside of a glove sealingly gripped between said sealing clamp and said wrist clamp.

A preferred apparatus according to the present invention comprises four finger mounting members and four finger receiving mandrels adapted to be arranged in substantial alignment therewith, with means for heating each mandrel. Such an apparatus simultaneously turns and blocks the four fingers of a glove which can be arranged to extend substantially parallel to one another from the hand portion of the glove. A further apparatus according to the invention comprises a single finger mounting member and a single finger receiving mandrel adapted to be arranged in substantial alignment therewith. Such apparatus can be used to turn and block simultaneously the thumb or an individual finger of a glove.

It has been found that, when a glove is turned by the process or using the apparatus of the present invention, there is exerted sufficient stretching and pressing of the stitched seams to effect blocking of the glove as it is turned. The blocking is achieved by the stretching of the glove finger as it is rolled or turned onto a larger diameter mandrel, and with supply or air pressure to reduce frictional forces encountered, and by the application of heat while it is in its thus stretched condition. The heat is best supplied by heating the larger diameter finger receiving mandrel, with which the glove finger and its seams come into intimate contact in the stretched condition. Heat can also be supplied by heating the air which is used to assist the turning. It has been found that about 75% of the desired blocking can be accomplished by the actual turning of the glove in accordance with the process of the invention. The remainder of the blocking is accomplished by retaining the glove on the larger heated finger receiving mandrel, for a brief period.

The prior art arrangements are unable to achieve this simultaneous blocking and turning, since they turn a glove finger from the outside of a relatively larger diameter tube onto the relatively smaller diameter rod or plunger inserted down the inside of the tube. Such turning action is accompanied by a general compression of the glove finger, not a stretching, and such compression is incompatible with blocking the glove finger at the same time. The subsequent step of blocking the glove which is required is not only more time consuming because it is a separate stage of the entire process, but is a more time consuming operation in itself. The combined blocking and turning operation according to the present invention can be accomplished in about 10 – 15 seconds in practice, whereas conventional separate blocking operations normally take of the order of 2 minutes to complete.

DESCRIPTION OF THE PREFERRED EMBODIMENTS

The finger mounting members of smaller diameter are preferably rods, and the finger receiving mandrels are preferably hollow or tubular, and arranged to be movable so that the fingers receiving mandrels will snugly surround the glove fingers on finger mounting member. The means for engaging the glove is suitably an expandable and retractable wrist clamp, arranged to move longitudinally with respect to the finger receiving mandrels and to surround them. The wrist clamp is expanded to engage the inside of the cuff or wrist portion of the glove. It is then moved longitudinally relative to the finger receiving mandrels and turn them right side out as it does so. As its travels continues the wrist clamp and associated structure cause turning of the fingers of the glove by rolling them from their initial inside out engagement with the finger mounting members into their right side out engagement with the outside of the heated finger receiving mandrels. This rolling and turning of the fingers is accomplished by stretching as previously described. At the end of its travel, when the glove has been fully turned and is clear of the finger mounting members, the wrist clamp releases the glove.

It is preferred to provide a means for reducing the frictional forces experienced by the glove fingers during turning. If the turning is effected merely by the action of the moving wrist clamp pulling the finger portions of the glove against the edge of the finger receiving mandrels, large frictional forces will be experienced by the finger portions during turning, with consequent risk of tearing the leather. Accordingly, the preferred apparatus of the invention includes means for reducing these frictional forces.

The preferred such means is a resilient clamp adapted to engage the upper edge of the turned wrist portion of the glove and clamp it against the upper edge of the wrist clamp in a substantially sealiing, air tight manner, and an associated means for supplying air to the vicinity of the turning of the finger around the lower end of the tubular finger receiving mandrel. The air so supplied urges the glove finger away from contact with the bottom edges of the tubular mandrels so as to reduce the frictional forces therebetween, and act as an air lubricant. Preferably also, the air so supplied is heated, to soften the leather to some extent. The sealing engagement of the resilient clamp against the wrist clamp forms a chamber from which air escape is restricted, so as to increase the air pressure inside the glove being turned and blow the glove away from hand contact with the mandrel edges.

Further reductions in this friction are preferably accomplished, by providing the end portion of the tubular mandrel with a low friction surface (e.g. a TEFLON coating), and by arranging for a jet of air to be directed at the area of contact between the glove finger and the end of the tubular mandrel as turning of the finger proceeds.

The mandrels onto which the finger portions of the glove are turned determine in large part the size of the finished glove fingers. So that the apparatus may be used to produce gloves of different sizes, therefore, it is convenient to make the mandrels removable and replacable with similar mandrels but of different sizes.

There are also preferably provided inner tubular members inside the tubular mandrels, said inner tubular member being provided with end formations shaped to cooperate with the finger ends. The inner tubular members are arranged so as to enter the finger ends on completion of the turning of the glove finger, to block the insides of the finger ends.

BRIEF DESCRIPTION OF THE DRAWINGS

A specific and preferred embodiment of an apparatus and process according to the present invention is illustrated in the accompanying drawings, in which.

In the drawings, like reference numerals indicate like parts.

DETAILED DESCRIPTION OF THE SPECIFIC PREFERRED EMBODIMENT

Figure 1:
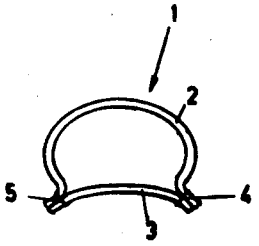
FIG. 1 is a diagrammatic cross section of a finger of an unfinished leather glove, after it has been stiched together but before turning from the inside out to the right side out condition.
Figure 2:
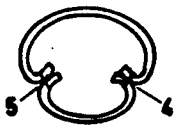
FIG. 2 is a diagrammatic cross section of the glove finger of FIG. 1, after turning but prior to blocking.
Figure 3:
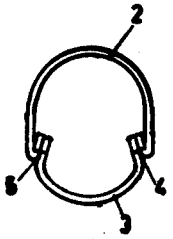
FIG. 3 is a diagrammatic cross section of the glove finger of FIG. 2 after blocking.

With reference to FIGS. 1-3, these illustrate the objective which the present invention sets out to achieve. The finger 1 of a leather glove is commonly made from two separate pieces of leather 2, 3 stitched together to form bulky seams 4, 5. The glove is stitched in its inside out position as shown in FIG. 1. When it is turned to the right side out position as shown in FIG. 2, the seams 4, 5 project inwardly a substantial distance. It is now necessary to flatten these seams, and generally press the inside of the finger, to make the inside thereof conform to the desired shape. After this operation, known as blocking, the finger assumes the general inside cross sectional shape shown in FIG. 3, in which seams 4, 5 have been flattened and the interior cavity expanded and shaped to the desired configuration. The subsequent drawings, FIGS. 4 through 12, illustrate an apparatus and process by which this is accomplished.

Figure 4:
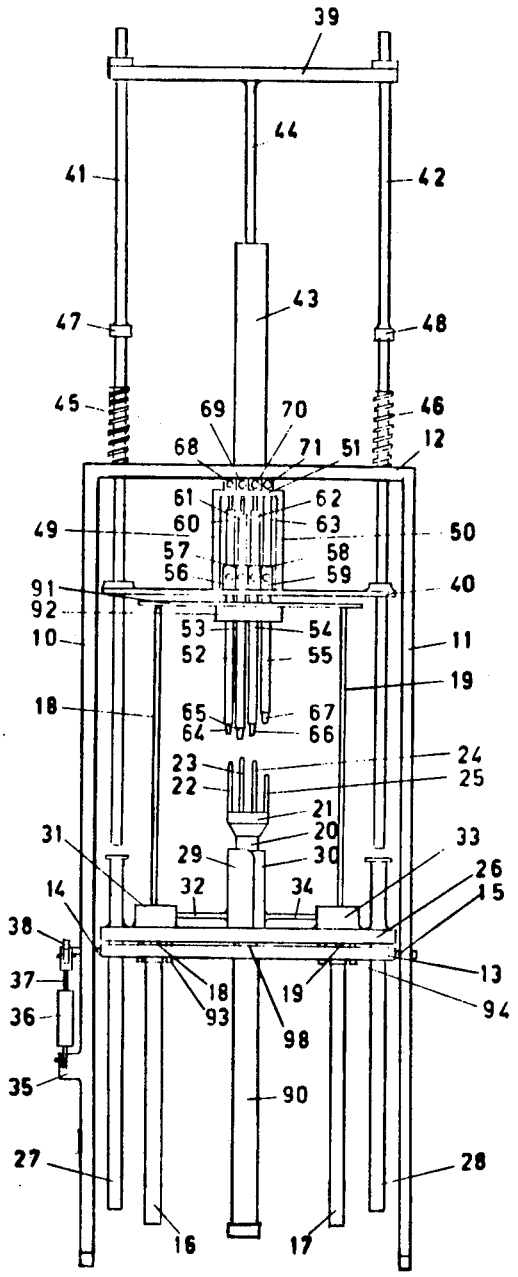
FIG. 4 is somewhat diagrammatic front view of a glove turning and blocking apparatus according to the invention.
Figure 6:
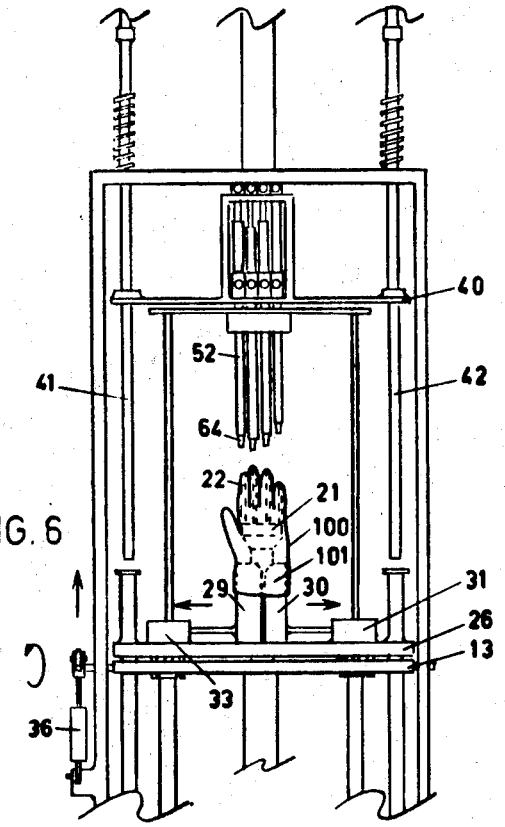
FIG. 6 is a front view of a portion of the apparatus of FIG. 4, in a first portion of the operating cycle.
Figure 7:
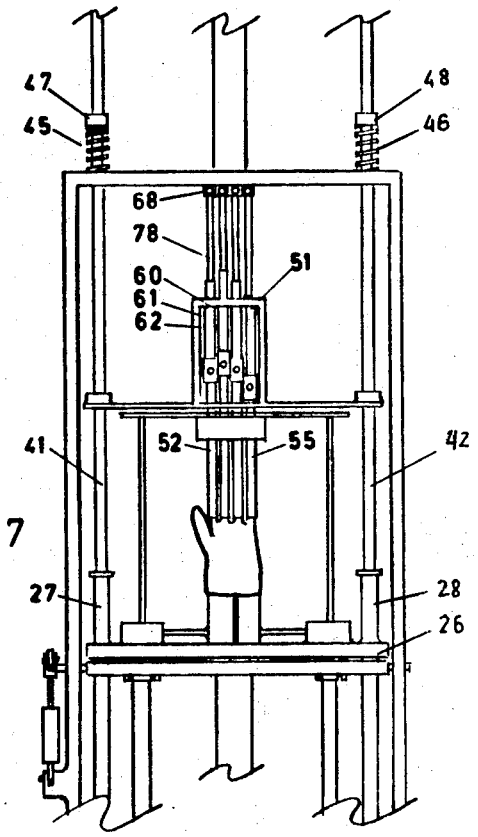
FIG. 7 is a view similar to FIG. 6, with the apparatus in a second position of the operating cycle.
Figure 8:
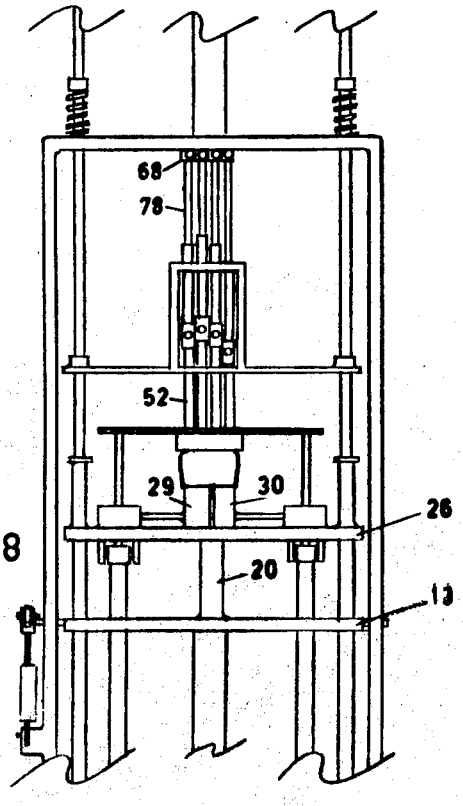
FIG. 8 is another view similar to FIG. 6, with the appparatus in a third position of the operating cycle.
Figure 9:
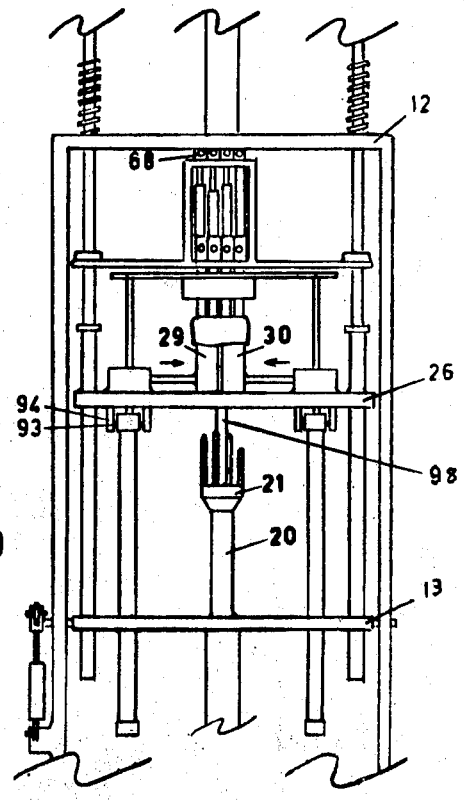
FIG. 9 is another view similar to FIG. 6 with the apparatus in a fourth position of the operating cycle.
Figure 10:
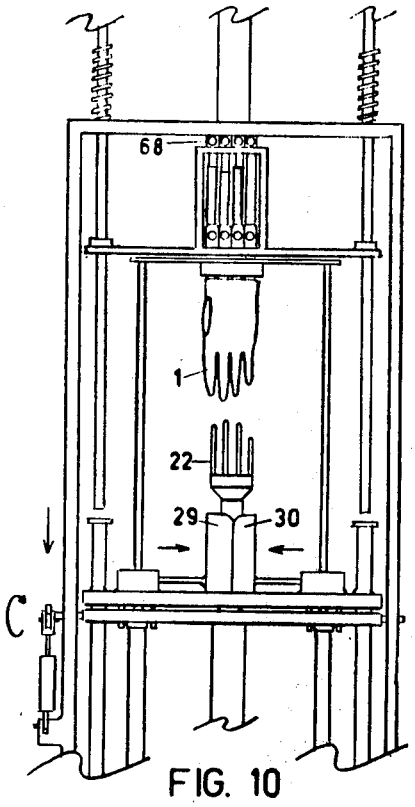
FIG. 10 is another view similar to FIG. 6 with the apparatus in a fifth position of the operating cycle.

With reference to FIG. 4, the apparatus comprises a fixed framework having vertical side members 10, 11 and a cross member 12. A bed 13 is pivotally mounted at 14, 15 in the vertical side members 10, 11 respectively, for limited pivotal movement about a generally horizontal axis. The bed 13 carried on its underside a vertically disposed hydraulic cylinder 90 containing a slidable piston rod 98 which passes upwardly through an aperture in the bed 13. Cylinder 90 is connected to a source of hydraulic power, which can raise and lower the piston rod 98 therein. The bed 13 has affixed to its upper surface an upwardly extending stem 20, carrying at its upper end a skeletal hand 21 with finger mounting members in the form of rods 22, 23, 24 and 25 projecting upwardly therefrom.

A movable table 26 is provided immediately above the bed 13. The table 26 is mounted on the upper end of piston rod 98 so that it can be raised and lowered in response to hydraulic pressure in cylinder 90. The table 26 is provided, at each side, with vertically extending guide tubes 27, 28 fixed to the table 26 and passing through apertures in the bed 13, so that the guide tubes raise and lower with the table 26. The table 26 is also apertured near its centre to allow passage of hand stem 20 therethrough.

The table 26 is provided on its upper surface with a wrist clamp comprising a pair of interfitting metal channel members 29, 30, which are movable towards and away from each other, in a horizontal plane, relative to table 26. Pneumatic cylinders 31, 33 with associated slidable piston rods 32, 34 are mounted on the upper surface of table 26. The piston rods 32, 34 are connected respectively to wrist clamp parts 29, 30 and can retract and expand the wrist clamp 29, 30 in response to pneumatic pressure in cylinders 31 and 33.

Vertical frame side member 10 is provided at its lower portion with an integral boss 35, to which is connected a pneumatic piston and cylinder arrangement 36, 37. The piston rod 37 connects via a crank arrangement 38 with the horizontal pivot 14 of the bed 13, so that the bed can be tilted by actuating cylinder 36.

A movable framework is provided, located generally above the bed 13, and movable in a vertical plane relative to the bed 13 and the fixed framework. The movable framework comprises an upper crosspiece 39 and a lower crosspiece 40. It also comprises vertical side rods 41, 42 secured to crosspieces 39, 40. Side rods 41, 42 pass through apertures in cross member 12 of the fixed framework, so that the lower portion of side rods 41, 42 are disposed inside but close to vertical side members 10, 11. The lower ends of side rods 41, 42 are vertically aligned with guide tubes 27, 28 respectively, associated with table 26, when the bed 13 and table 26 are in their normal, non-tilted position.

A pneumatic cylinder 43 is mounted on the upper surface of cross member 12 of the fixed framework, with its associated piston rod 44 extending vertically upward, and secured at its upper end to the middle of crosspiece 39 of the movable framework. This pneumatic cylinder 43 can be actuated to raise and lower the movable framework with respect to the fixed framework.

Compression springs 45, 46 are provided, seated in the upper surface of the cross member 12, and surrounding side rods 41, 42 respectively. The upper ends of the springs 45, 46 are adapted to be engaged by stop formations 47, 48 on respective side rods 41, 42 when the movable framework is lowered, to be compressed thereby when the movable framework is lowered to its full extent. The function and purpose of these springs 45, 46 is described hereinafter.

The lower crosspiece 40 of the movable framework carries on its upper surface of upstanding subsidiary frame with side walls 49, 50 and a head wall 51. Four tubular finger receiving mandrels 52, 53, 54, 55 extend downwardly in a slidable manner through apertures in the crosspiece 40 in substantial longitudinal alignment with respective finger rods 22, 23, 24, 25 of the skeletal hand 21 associated with the fixed bed 13. The upper ends of tubular mandrels 52, 53, 54, 55 are secured to retaining members 56, 57, 58, 59 respectively, which abut against the upper surface of crosspiece 40, in the space defined by the subsidiary frame, and hence limit the downward protrusion of tubular mandrels 52, 53, 54, 55. Tubular stops 60, 61, 62, 63 of different lengths for the respective mandrels extend upwardly from retaining members 56, 57, 58, 59. Apertures are provided in head wall 51 of the subsidiary frame, through which tubular stops 60, etc. can slidably pass in certain operating positions of the apparatus.

Figure 5:
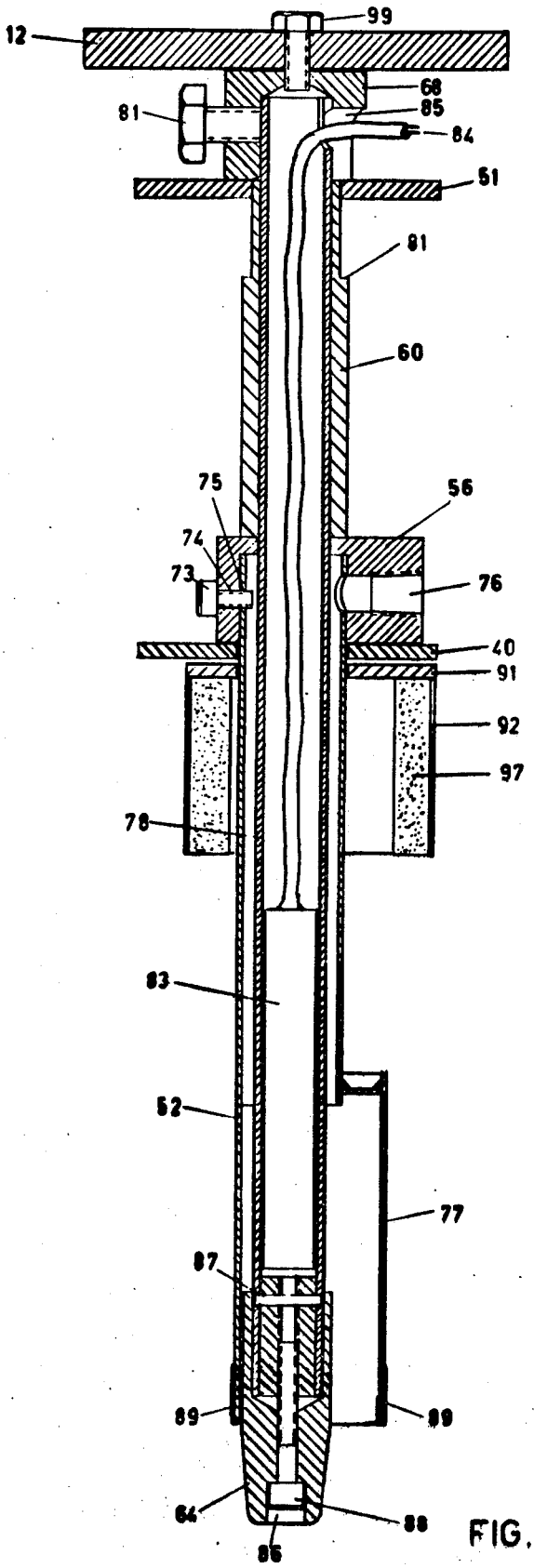
FIG. 5 is a longitudinal cross sectional view of a detail of the apparatus of FIG. 4.

These are disposed within tubular mandrels 52, etc. respective inner tubular members 78 best shown in FIG. 5, the lower ends of which 64, 65, 66, 67 are bullet-like, and are visible in FIG. 4 protruding from the lower ends of the respective tubular mandrels 52, etc. The inner tubular members 78, etc. extend upwardly within the tubular mandrels 52, etc. through associated stop members 56, etc., through tubular stops 60, etc. and through the apertures in the head wall 51. Above the head wall 51, the upper ends of inner tubular members 78, etc. are secured in respective retaining members 68, 69, 70, 71 which in turn are releasably secured to head wall 51.

Now referring to FIG. 5, this illustrates in vertical cross section the tubular finger receiving mandrel 52 and associated parts, viewed from the side with respect to FIG. 4. It will be understood that the other mandrels 53, 54, 55 are essentially identical with the mandrel 52. At its upper end, the mandrel 52 extends slidably through an aperture in lower crosspiece 40 of the movable framework. The upper end, above the crosspiece 40, is received in and terminates in a retaining member 56, releasably secured thereto by means of a screw 73 which is threadably received in a screw threaded aperture 74 in the side of the retaining member 56 and extending into an aperture 75 on the side of the mandrel 52. The opposite side of the retaining member 56 is provided with a horizontal bore 76 by means of which air pressure can be introduced to the interior of the mandrel 52. The tubular stop 60 rests on and effectively forms the upper part of the retaining member 56. The inner tubular member 78, which as noted is fixed to the fixed framework member 12, is located inside tubular stop 60 which is slidable with respect thereto. The movable framework is slidable with respect to both tubular stop 60 and inner tubular member 78, and these extend through an aperture in the head wall 51 thereof. Tubular stop 60 is provided with a shoulder 81 which limits the extent to which it may pass through the aperture in head wall 51. The lower part of the mandrel 52 is provided with a portion 77 of larger cross section.

The inner tubular member 78 is disposed inside the mandrel 52 and terminates at its lower extremity in removable bullet 64 extending below the end of the mandrel 52. The member 78 and its associated parts maintain a fixed, stationary position, being secured by bolt 99 to the fixed framework 12. At its upper end member 78 is releasably received in retaining member 68 by means of laterally extending screw 80 threadably received in a screw threaded aperture 81 and clamped against the side of the inner tubular member 78. Retaining member 68 is releasably secured to frame member 12 by bolt 99. Its lower surface limits the upward travel of tubular stop member 60 and head wall 51 of the subsidiary framework.

Located within inner tubular member 78 near its bottom end is an electrical cartridge heater 83, the leads 84 from which pass upwardly inside the tube 78 and out of a lateral aperture 85 in the tube 78 and retaining member 68, to a source of electrical heating power, not shown. The heater 83 serves to heat inner tubular member 78 and mandrel 52.

The bullet 64 is of solid metal, namely aluminum, and is adapted to be removable from the tube 78. For this purpose, the bullet 64 is provided with a countersunk upwardly extending screw threaded bore 86. A closure plate 87 is provided near the bottom of the tube 78. The closure plate has a screw threaded aperture so that a screw 88 passing upwardly through the bore 86 of the bullet 64 attaches the bullet 64 releasably to the tube 78. Free space is left between the bullet 64 and the enlarged portion 77 of the mandrel. Thus a jet of air introduced through bore 76 has free communication with and exits from the bottom of the mandrel 52.

At its lower extremity, the tube 52 is provided on both its inner and outer surfaces and edge with a low friction coating 89 of TEFLON, to assist in the turning operations.

As noted, the glove fingers are received over the enlarged lower portion 77 of the mandrel 52 in operation, and according to the invention are stretched and blocked as they are received thereon. The mandrel 52 thus has an important role in determining the size of the finished glove. Tubular mandrel 52 is made removable from the apparatus, so that such mandrels of different sizes can be used, for use in turning different sized globes. To remove mandrel 52, screw 73 is unfastened, and tube 52 can then be removed downwardly from the assembly. An alternate tube is then inserted, and screw 73 fastened.

Figure 12:
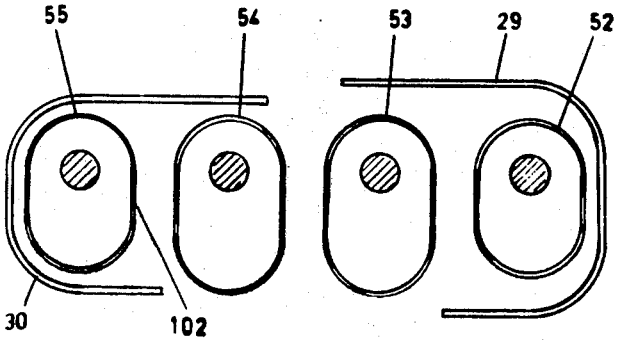
FIG. 12 is a diagrammatic cross sectional view of a detail of the machine, along the line 12—12 of FIG. 11, turned through 90° to show other finger receiving mandrels, and with the wrist clamp expanded.

With reference to FIG. 12, this shows in cross section the arrangement of the tubular mandrels 52, 53, 54, 55 at their enlarged lower portions. Their cross sectional shape is generally oval with straight longitudinal sides 102. Convenient and substantially constant spacing should be maintained between them, since they must align with the rods 22, 23, 24, 25 of the skeletal hand 21, and have sufficient spacing from one another to allow the turning of the fingers of the glove onto their exterior surfaces. Thus the curvature of the semi-circular ends of the tubes 52, etc. is kept constant, to maintain constant width. The different sizes of tubes 52, etc. are arranged by providing tubes of different straight side 102 lengths. As shown in FIG. 12, for any given glove different sizes of tubes are used for the respective fingers.

On the bottom surface of the tiltable bed 13 of the apparatus and depending therefrom are a pair of pneumatic cylinders 16, 17 with associated upwardly extending piston rods 18, 19. This is shown in FIG. 4. The cylinders 16, 17 are hingedly mounted by means of hinges 93, 94 on the bed 13, to accommodate the tilting of the bed 13, table 16 and skeletal hand 21, for loading the glove as hereinafter described, so that cylinder 16, 17 and rods 18, 19 remain generally vertically disposed when this tilting occurs. At their upper ends, the rods 18, 19 carry a cross beam 91 extending between them. The cross beam 91 carries on its lower surface a muffling claimp 92 bearing a resilient pad 97 which is in the form of a collar, through which the mandrels 52, 53, 54, 55 extend. The cross beam 91 is apertured to allow passage of the mandrels 52, etc. therethrough, these apertures being sized so that a very close but sliding fit is obtained between the cross beam 91 and mandrels 52, etc. The cross beam 91 and muffling clamp 92 are raised and lowered by supplying pneumatic pressure to cylinders 16, 17, so as to bring the bottom edge of resilient pad 97 into engagement with the top of wrist clamp 29, 30 during the cycle of operation.

The operation of the machine as described herein will now be described, with reference to FIGS. 4 and 6 through 11.

Referring firstly to FIG. 4, at the start of the operating cycle the movable table 26 is at its lowermost position resting on the fixed bed 13. Pneumatic cylinder 36 is normally actuated to cause a forward tilting of the bed 13 and table 26 with associated parts including the skeletal hand 21. The extent of this tilt is limited by suitable stop means not shown. An inside out and unblocked glove 100 (seen in FIG. 6) is mounted on the skeletal hand 21. It will be noted that the finger rods 22, 23, 24 and 25 are or different lengths, to cooperate with the different lengths of the glove fingers, the pinky rod 25 being the shortest. The glove is mounted with the appropriate finger rods extending into the appropriate glove fingers, and with the cuff 101 of the glove 100 extending over the parts 29, 30 of the wrist clamp, which are at this stage in their retracted position. This forward tilted position of the skeletal hand 21 facilitates very greatly the operator's task in mounting the glove 100 thereon, and reduces risk of the operator's touching the heated mandrels 52, 53, 54 and 55 during such loading. It also facilitates air blast-off removal, from the mandrels, of the glove turned and blocked during the previous machine cycle. During this tilting, cylinders 16, 17 remain generally vertical, due to pivoting of hinges 93, 94.

Next, the pneumatic pressure in cylinder 36 is switched, and the table 26 and bed 13 and associated parts tilt back to their vertical positions. Then cylinders 31 and 33 are actuated, to expand the wrist clamp 29, 30 inside the cuff 101 of the glove 100 so that the cuff 101 is firmly gripped. The apparatus is now in the position shown in FIG. 6.

The movable framework including the crosspiece 40, tubular mandrels 52, 53, 54, 55 and muffling clamp 92 are now lowered with respect to the table 26 and bed 13 holding the skeletal hand. Tubular mandrels 52, 53, 54, 55 fit over the glove fingers mounted upon respective finger rods 22, 23, 24, 25. Proper vertical alignment is ensured by the cooperation of the lower ends of side rods 41, 42 of the movable framework being received inside guide tubes 27, 28 fixed to the table 26. If the alignment is incorrect, the rods 41, 42 and the tubes 27, 28 will abut and jam, preventing damaging engagement of the mandrels 52, 53, 54, 55 with the skeletal hand 21. The downward movement of the movable framework is set to a predetermined extent, defined by suitable limit switches, until the lower edge of the longest tube mandrel 53 engages the bottom of the middle finger of the glove. This downward movement of the movable framework occurs relative to the inner tubular members 78, etc., which are fixed to the fixed framework 12. Thus the bullets 64, etc. are effectively retracted within the mandrels 52, etc., when this downward movement occurs, and are kept clear of contact with the ends of the fingers on the skeletal hand at this stage. Downward movement of the movable framework causes head wall 51 of the subsidiary framework to engage shoulder 81 of the tubular stop 60. The positions of the shoulders 81 on the respective tubular stops 60, 61, 62, 63 are arranged so that, when they are engaged by head wall 51, the bottoms of the mandrels 52, 53, 54, 55 form a substantially straight horizontal line. This arrangement greatly facilitates the ease of turning the hand portion of the glove, and minimizes the risk of tearing the leather, due to the application of uneven forces across the width of the hand portion of the glove. The apparatus has now assumed the position shown in FIG. 7. During this downward travel of the movable framework including cross-piece 40 and tubular mandrels 52, 53, 54, 55 the stop formations 47 and 48 will engage springs 45 and 46. Compression of these springs will result in greatly reduced downward weight force of the movable frame, and hence reduce very substantially downward urging of the tubular mandrels 52, 53, 54, 55, and lessen the force exerted on the glove.

Next, the downward force in cylinder 43 is stopped. The table 26 now moves upwardly relative to the bed 13 and skeletal hand 21, and the muffling clamp 92 moves downwardly due to actuation of cylinders 16, 17. The table 26 brings the wrist clamp 29, 30 upwardly in its expanded, glove engaging position. This causes turning to the right side out condition of the hand portion of the glove 100, about the top edge of the wrist clamp 29, 30 and the bottom edges of the tubular mandrels 52, 53, 54, 55, which as noted at this time are arranged in a generally straight horizontal line to facilitate this turning. The lateral expansive force of the wrist clamp assists in the blocking of the palm portion of the glove as it is turned. Turning of the hand portion of the glove 100 by upward movement of the wrist clamp is completed before turning of the finger portions commences. At this stage, the apparatus has assumed the position shown in FIG. 8. The hand portion of the glove is turned right side out and now lies inside the wrist clamp 29, 30. The cuff remains inside out, firmly gripped by and lying outside of the wrist clamp 29, 30. The finger 1 is inside out and has not started to turn. It rests on finger rod 22.

Figure 11:
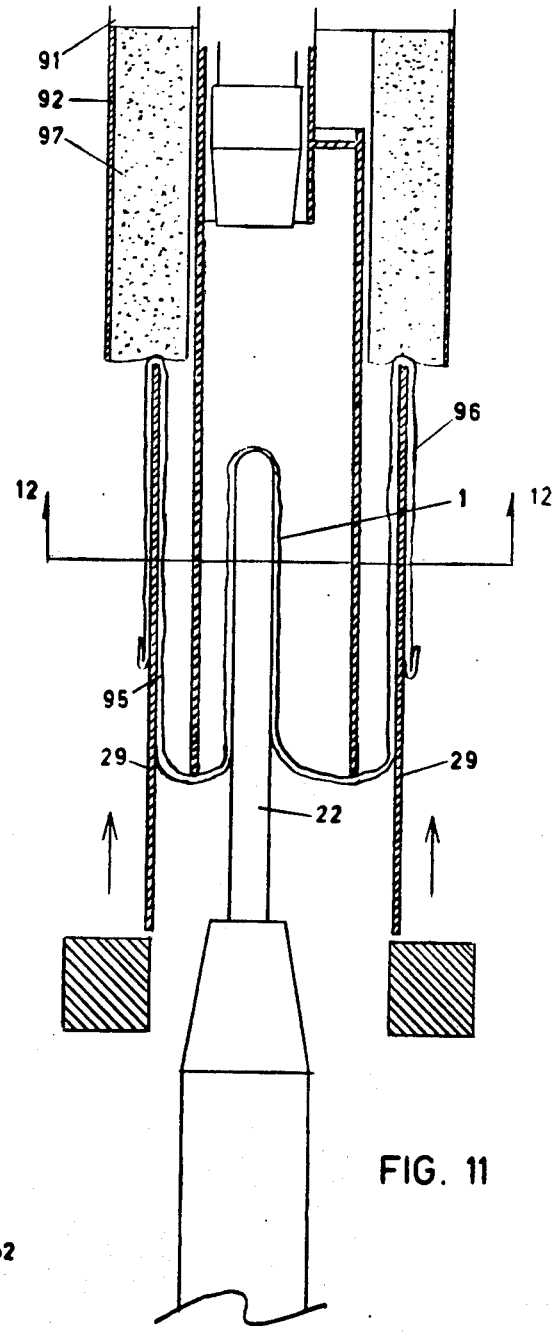
FIG. 11 is a diagrammatic longitudinal cross sectional view of a detail of the apparatus of FIG. 4, showing parts of the apparatus in the operating position of FIG. 8.

Next, preparatory to turning the fingers 1, the wrist clamp 29, 30 and muffling clamp 92 move towards each other so that the resilient collar 97 of the muffling clamp engages the portion of the glove supported by the top edge of the wrist clamp 29, 30 and forms a substantially air-tight seal therewith, as shown in FIG. 11. The wrist clamp 29, 30 is then relaxed a little, to reduce the lateral force exerted on the hand portion of the glove 100. This also permits better alignment of the glove and the mandrels, to reduce risk of tearing the glove. A largely air-tight chamber has now been formed with the glove and the muffling clamp, escape of air therefrom only being permitted to a limited extent through the apertures in cross head 91 around the mandrels 52, etc. passing therethrough. Heated air is now blown into this chamber, through aperture 76, and down tubular mandrel 52, which has the effect of blowing out the glove from the end of tubular mandrel 52, to reduce the frictional forces therebetween and act as a lubricant for the turning. Wrist clamp 29, 30 on table 26, muffler clamp 92 and tubular finger receiving mandrel 52 now all move upwardly, whilst finger rod 22 and bullet 64 remain stationary, the sealing engagement of muffler clamp 92 and wrist clamp 29, 30 and glove thereon, and the air pressure in the chamber formed by the glove, being maintained as shown in FIG. 11 during this upward movement. This gripping of the glove between the collar 97 and wrist clamp causes the glove to be drawn upwardly and the fingers turn onto mandrels 52 as the clamps move upwardly. No relative movement of the glove around the top edge of the wrist clamp takes place at this stage. As mandrels 52, etc. move up, the tubular stop members 60 etc. associated therewith come into contact at their upper ends with the associated retaining members 68 etc. secured to the fixed framework 12, so as to limit the upward travel of the mandrels 52, etc. The shoulders 81 then come out of engagement with the head wall 51 of the subsidiary framework, which can continue upward travel until it too engages retaining members 68, etc. as shown in FIG. 5. The profile of the bottom ends of the mandrels 52, 53, 54, 55 corresponding to respective glove finger lengths is then restored, defining turning locations for the fingers.

Thus, the glove fingers turn onto the large diameter mandrels 52, etc. from the smaller diameter rods 22, the mandrels 52, etc. being heated by the cartridge heater 83, and also by the supply of heated air previously described. This simultaneous stretching and heating as the glove finger is turned causes a substantial degree of blocking. When the muffling clamp 92, subsidiary frame 51 and mandrels 52, etc. have withdrawn upwardly to their fullest extent, the apparatus has assumed the position shown in FIG. 9. Now, the bullets 64, etc. project below the ends of the respective mandrels 52, etc., as shown in FIGS. 4 and 5, and these bullets enter the finger tips to ensure that they are fully turned and to assist in their blocking.

A small degree of further upward travel of the wrist clamp 29, 30 with the wrist clamp relaxed, completes the turning of the glove 100, by turning the cuff. Then the wrist clamp 29, 30 on table 26 is withdrawn downwardly, leaving the glove 91 suspended on the mandrels 52, 53, 54, 55 where it is retained briefly so as to complete the blocking. This is the position of the apparatus illustrated in FIG. 10. Then the glove is removed from the machine, suitably by a blast of air from bore 76, and the machine is ready for a new cycle of operation.

The control means for the machine of the invention are not illustrated, but it will be appreciated that their design and operation are within the skill of the art. Thus a suitable interconnection of pneumatic pressure supplies and sequential operating controls is associated with cylinders, 36, 16, 17, 31, 33, 43 and 90 to arrange a cycle of operations as described herein. The apparatus cycles semi-automatically with the operator switching on the operating cycle after loading a glove onto skeletal hand 21 with the table 26 and bed 13 in their tilted forward position, whereupon the apparatus automatically completes a cycle and returns to this same position.

The apparatus can be operated at high speeds, with the entire cycle of automatic operation being completed in a period of from 10 - 30 seconds. To complete the blocking of the glove 100, it needs to remain in stretched contact with the heated tubular mandrels 52, 53, 54 and 55 only for a period of about 10 seconds. The mandrels 52, etc. can be heated to relatively high temperatures, such as 250°-500° F to accomplish the blocking, since the glove contacts them for only a brief interval.

Whilst the process and apparatus of the invention have been specifically described with reference to the making of leather gloves, it will be appreciated that it can be used with gloves of other, similar materials also. Gloves of a material which is preformed and requires parts to be stitched or otherwise secured together as seams, the material having the characteristic of stretching with a degree of resilience, can be made according to the invention.

The embodiments of the present invention described above are intended to be illustrative, preferred embodiments only, and the scope of the present invention is defined by the appended claims.

We claim:

1. A process of turning and blocking at least one finger of a glove of leather or similar material, which comprises:

mounting a stitched glove with said at least one finger thereof in an inside out condition over a finger mounting member of relatively small diameter;

transferring said glove finger by rolling it onto an exterior surface of a hollow, open-ended finger receiving mandrel of relatively larger diameter with simultaneous stretching of said finger, thereby turning the glove finger to its right side out condition;

applying a stream of heated air between said glove finger and said finger receiving mandrel at the location of turning of said glove finger thereonto as said turning is being effected so as to urge the glove finger away from the mandrel at said location;

and removing the glove from said finger receiving mandrel.

2. The process of claim 1 which includes the steps of moving the finger receiving mandrel relatively to the finger mounting member at least partially to surround the glove finger mounted on said finger mounting member, and then rolling the glove finger outwardly onto the finger receiving mandrel as the finger receiving mandrel is withdrawn relatively away from the finger mounting member.

3. The process of claim 2 wherein additional heat is applied to the glove finger as it is turned, by heating said finger receiving mandrel of relatively larger diameter.

4. The process of claim 3 wherein four fingers of a stitched inside out glove are simultaneously turned and blocked.

5. A process of turning and blocking a stitched inside out glove of leather or similar material which comprises the steps of:

mounting said glove, in an inside out condition, on a fixed skeletal hand having finger mounting members of rod-like form and relatively small diameter, with the finger mounting members extending longitudinally inside and substantially to the ends of the fingers of the glove;

moving tubular mandrels, of relatively larger diameter, over the respective glove finger bearing finger mounting members so as substantially to surround the glove fingers, and to form a generally straight line for turning purposes defined by the extremities of said tubular mandrels;

gripping the wrist portion of the glove laterally in clamping means adapted to move longitudinally of the skeletal hand;

moving said clamping means and wrist portion of the glove gripped thereby towards said tubular mandrels and thereby turning the hand portion of the glove to its right side out condition with simultaneous lateral stretching of the hand portion by said clamping means;

sealing the turned edge of the hand portion in substantially air-tight manner against a resilient sealing collar by bringing the clamping means engaging said turned edge into engagement with a resilient collar so as to form a chamber of restricted air escape inside the partially turned glove;

releasing said clamping means to release lateral stresses on said hand portion;

supplying heated air to said chamber of restricted air escape so as to urge the finger portion of the glove away from said tubular mandrels;

continuing the moving of the clamping means and wrist portion of the glove away from the fixed skeletal hand so as to turn the finger portions of the glove onto the tubular mandrels;

withdrawing the clamping means from engagement with the glove; and removing the turned glove from the tubular mandrels.

6. Apparatus for turning and blocking gloves comprising:

at least one finger mounting member of relatively small diameter adapted to be received inside a finger of a stitched, inside out glove mounted thereon;

at least one finger receiving mandrel of relatively larger diameter adapted to be arranged in substantial longitudinal alignment with said at least one finger mounting member;

an expandable and retractable wrist clamp adapted to expand to grip the inside of the wrist portion of the glove mounted on said at least one finger mounting member, said wrist clamp being movable relative to said at least one finger mounting member in a direction longitudinally thereof towards and away from said at least one finger receiving mandrel, for transferring a glove finger mounted on said at least one finger mounting member onto said at least one finger receiving mandrel by rolling the finger onto the outer surface thereof;

a sealing clamp surrounding said at least one finger receiving mandrel and adapted to engage with the edge of the wrist clamp to grip therebetween in substantially sealing manner an edge of a glove gripped by said wrist clamp, around the periphery of said edge;

means for supplying air pressure to the inside of a glove sealingly gripped between said sealing clamp and said wrist clamp.

7. Apparatus according to claim 6 wherein said finger receiving tubular mandrels are removable and replacable with other similar tubular mandrels of different sized external periphery, to accommodate glove fingers of different sizes.

8. Apparatus according to claim 6 including a skeletal hand having four finger mounting members protruding therefrom in substantially parallel relationship, and including four finger receiving mandrels adapted to be arranged in substantial alignment therewith.

9. Apparatus according to claim 8 wherein said finger mounting members are of rod-like form and said finger receiving mandrels are of hollow open-ended form, the finger receiving mandrels being movable to surround said glove fingers mounted on said finger mounting members, and being dimensioned so as to be a snug fit thereover.

10. Apparatus according to claim 9 including means for heating the finger receiving mandrels.

11. Apparatus according to claim 7 wherein said skeletal hand is tiltable to bring the finger mounting members out of alignment with the finger receiving mandrels.

12. Apparatus according to claim 11, including a fixed bed to which the skeletal hand is secured in generally upwardly extending relation, and a movable table disposed above said fixed bed and to which the wrist clamp is secured, said movable table being movable in a vertical plane above said fixed bed.

13. Apparatus according to claim 7 wherein said sealing clamp comprises a cross beam apertured for close sliding passage therethrough of said finger receiving mandrels, and a collar of resilient material extending from said cross beam, said resilient material being sealingly engageable with the edge of the wrist clamp, said sealing clamp being movable longitudinally relative to the skeletal hand, and relative to the wrist clamp and relative to the finger receiving mandrels.

14. Apparatus according to claim 13 wherein said means for supplying air pressure to the inside of the glove comprises at least one conduit extending longitudinally through a finger receiving mandrel.

* * * * *